United States Patent [19]

Sato et al.

[11] Patent Number: 4,978,823

[45] Date of Patent: Dec. 18, 1990

[54] SEESAW-TYPE SWITCH DEVICE HAVING A SNAP-COUPLED ACTUATOR

[75] Inventors: Hiroyuki Sato; Yujiro Shimoyama, both of Furukawa, Japan

[73] Assignee: Alps Electric Co., Ltd., Tokyo, Japan

[21] Appl. No.: 349,880

[22] Filed: May 9, 1989

Related U.S. Application Data

[63] Continuation of Ser. No. 160,915, Feb. 26, 1988, abandoned.

[30] Foreign Application Priority Data

Jun. 1, 1987 [JP] Japan ..... 62-83185[U]

[51] Int. Cl.[5] ..... H01H 5/08

[52] U.S. Cl. ..... 200/437; 200/553; 200/339

[58] Field of Search ..... 200/553, 557, 558, 559, 200/437, 339

[56] References Cited

U.S. PATENT DOCUMENTS

| | | | |
|---|---|---|---|
| 2,808,482 | 10/1957 | Zanichkowsky, et al. | 200/437 X |
| 2,961,505 | 11/1960 | Alio et al. | 200/437 |
| 3,935,411 | 1/1976 | Ford | 200/437 |
| 4,314,121 | 2/1982 | Gaber | 200/433 |
| 4,367,386 | 1/1983 | Sovenson | 200/339 X |
| 4,680,435 | 7/1987 | Sovenson | 200/339 X |
| 4,686,339 | 8/1987 | Sapone | 200/339 |
| 4,767,895 | 8/1988 | Parrish | 200/339 X |
| 4,780,580 | 10/1988 | Sewada | 200/438 |

*Primary Examiner*—Renee S. Luebke

*Attorney, Agent, or Firm*—Guy W. Shoup; David W. Heid

[57] ABSTRACT

A switch device wherein components including an actuator bar and a spring can be installed one after another from above an upper opening of a casing, enabling automation of an assembling operation. The switch device includes a conductor plate mounted for rocking motion within a casing to cause switching of the switch device, and a switch operating member mounted for pivotal motion on the casing and including an actuator element and an operating element snap-coupled to each other. The actuator element has a vertical through-hole perforated therein while the operating element has formed thereon a depending projection which is received in the through-hole of the actuator element. An actuator bar and a compression spring are received in the through-hole of the actuator element such that the compression spring abuts at opposite ends thereof with an end of the projection of the operating element and an end of the acutator bar so that it normally urges the actuator bar to resiliently contact with the conductor plate for operation of the latter.

4 Claims, 4 Drawing Sheets

SEESAW-TYPE SWITCH DEVICE HAVING A SNAP-COUPLED ACTUATOR

This application is a continuation of application Ser. No. 07/160,915, filed Feb. 26, 1988, and now abandoned.

BACKGROUND OF THE INVENTION

This invention relates to a switch device, and more particularly to a switch device of the seesaw type wherein a switch operating member is tilted to effect switching of the switch device.

Various types of switch devices have been used so far depending upon their applications. Switch devices which are conventionally used for operation of motors of antenna lifting devices or power window devices for cars are principally of the seesaw type. An exemplary one of such switch devices of the seesaw type is shown in FIG. 4.

Referring to FIG. 4, the switch device shown includes a switch operating member 20 having a pressing member 22 mounted at the top thereof. As the pressing member 22 is suitably manually pressed, the switch operating member 20 is rocked in one of opposite directions indicated by a double-headed arrow mark X-Y around a fulcrum provided by a pair of support tabs 21. The switch operating member 20 has a blind hole 23*a* formed therein, and a compression coil spring 23 and an actuator bar 24 are received in the blind hole 23*a*. The actuatior bar 24 is urged by the compression coil spring 23 into sliding contact with a conductor plate 25 located below the switch operating member 20. The conductor plate 25 is supported for rocking motion like a seesaw around a fulcrum provided by the top of a central terminal 26 and has a pair of movable contacts 27*a* and 27*b* mounted at opposite ends thereof. A pair of fixed contacts 30*a* and 30*b* are located for contact with the movable contacts 27*a* and 27*b*, respectively, and are connected to terminals 28 and 29, respectively. The terminals 26, 28 and 29 are mounted on a casing 31.

With the construction described above, if the pressing member 22 is depressed at one of opposite end portions thereof, the pressing member 22 and the switch operating member 20 integral therewith are rocked in one of the X and Y directions around the fulcrum provided by the support tabs 21. In the case of the arrangement shown in FIG. 4, the pressing member 22 and the integral switch operating member 20 are shown rocked in the X direction. In this case, the conductor plate 25 is rocked in the counterclockwise direction in FIG. 4 around the fulcrum at the top of the central terminal 26 until the movable contact 27*a* thereon is contacted with the fixed contact 30*a*. On the contrary, if the switch operating member 20 is rocked in the Y direction, similarly the movable contact 27*b* will be contacted with the fixed contact 30*b*.

By the way, in the switch device of the construction described above, the actuator bar 24 received together with the compression coil spring 23 in the bottomed blind hole 20*a* of the switch operating member 20 is held in resilient contact with an upper face of the conductor plate 25. Accordingly, in assembling the switch operating member 20 to the casing 31, it is necessary either to manually install the switch operating member 20 into the casing 31 from the side of an opening at the top of the casing 31 while paying attention so that the compression coil spring 23 and the actuator bar 24 may not drop out of the blind hole 20*a* of the switch operating member 20 or to install the switch operating member 20 into into the casing 31 with the switch operating member 20 held upside down. This makes a significant factor which prevents automation of an assembling operation.

SUMMARY OF THE INVENTION

Accordingly, it is an object of the present invention to provide a switch device which eliminates the problem of the conventional arrangement described above and wherein components including an actuator bar and a spring can be installed one after another from the side of an upper opening of a casing, enabling automation of an assembling operation.

In order to attain the object, according to the present invention, there is provided a switch device which comprises a casing, a switch operating member supported for pivotal motion at an upper portion of the casing and including an actuator element and an operating element snap-coupled in an integral relationship to each other, the actuator element having a through-hole perforated therein, the operating element having a depending projection formed thereon and inserted in the through-hole of the actuator element, a conductor plate mounted for rocking motion within the casing, an actuator bar received in the through-hole of the actuator element, and a compression spring received in the through-hole of the actuator element and interposed between and abutting with an end of the projection of the operating element and an end of the actuator bar for urging the actuator bar to contact with the conductor plate, whereby a tilting motion of the switch operating member to slidably move the actuator bar on the conductor plate will cause rocking motion of the conductor plate to make a switching operation of the switch device.

With the construction described above, it is possible to interpose the spring between the actuator element and the projection of the operating element by snap-coupling the operating element to the actuator element after the actuator bar and the spring have been inserted one after another into the through-hole perforated in the actuator element from above. Accordingly, all the parts can be installed from the side of an upper opening of the casing, and consequently an assembling operation using an automated machine which has been considered difficult so far is enabled.

The above and other objects, features and advantages of the present invention will become apparent from the following description and the appended claims, taken in conjunction with the accompanying drawings.

DETAILED DESCRIPTION OF THE PREFERRED EMBODIMENT

Figure 1:
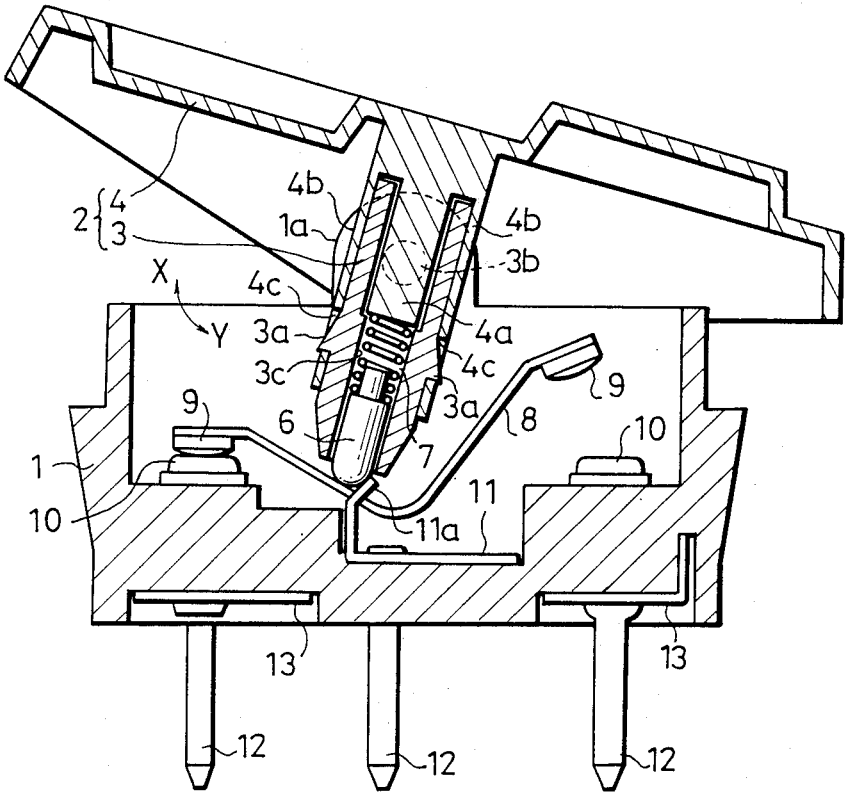
FIG. 1 is a cross sectional view of a switch device showing a preferred embodiment of the present invention.
Figure 2:
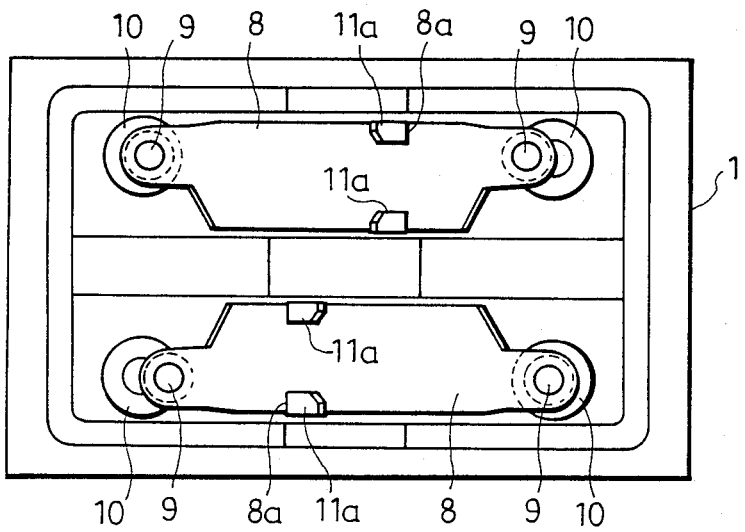
FIG. 2 is a top plan view of the switch device of FIG. 2 with a switch operating member omitted.
Figure 3:
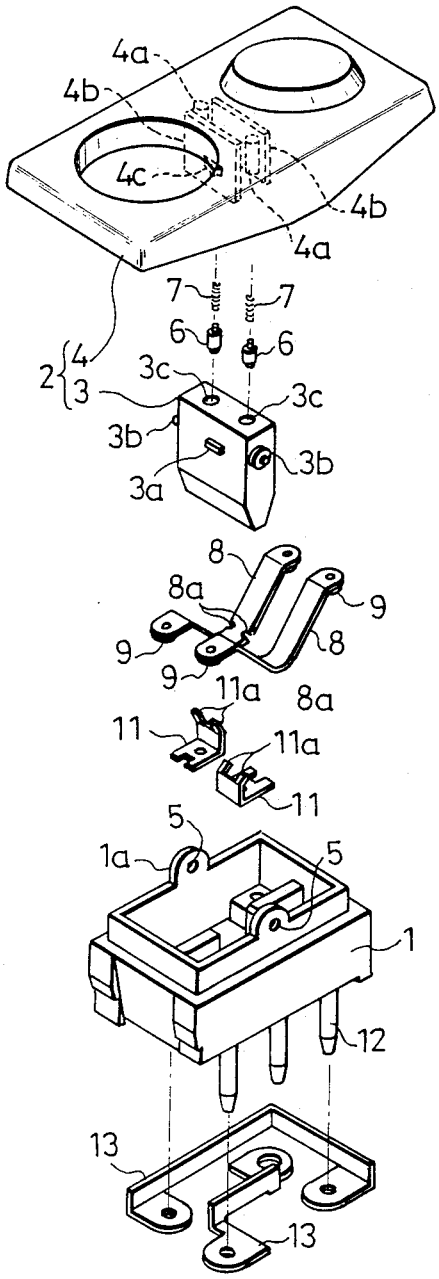
FIG. 3 is a fragmentary perspective view of the switch device of FIG. 1.

Referring to FIGS. 1 to 3 which show a switch device embodying the present invention, the switch device shown includes a case 1 made of a synthetic resin material and having an opening at the top thereof, and a switch operating member 2 supported for pivotal motion at an upper portion of the case 1. The switch operating member 2 includes an actuator element 3 and an operating element 4 assembled in an integral relationship to each other.

A pair of arresting projections 3*a* are formed in an integral relationship on opposing walls of the actuator element 3 while a pair of pins 3*b* are formed in an integral relationship on the other opposing walls of the actuator element 3. The pins 3*b* of the actuator element 3 are received for pivotal motion in a pair of holes 5 formed in opposing tabs 1*a* which are formed at the top of the case 1. A pair of vertically extending through-holes 3*c* are perforated in the actuator element 3, and an actuator bar 6 and a compression coil spring 7 are received in each of the through-holes 3*c* such that a lower end of each of the actuator bars 6 is held in resilient contact with an upper face of a corresponding one of a pair of conductor plates 8 which will be hereinafter described.

Meanwhile, a pair of depending projections 4*a* are provided in a spaced relationship by a predetermined distance in the lateral direction of the operating element 4 at the the center of a lower face of the operating element 4 while another pair of depending support plates 4*b* are provided in a spaced relationship by another predetermined distance in the longitudinal direction of the operating element 4 at the center of the lower face of the operating element 4 with the projections 4*a* interposed therebetween. An arresting hole 4*c* is formed in each of the supporting plates 4*b* of the operating element 4. Thus, as the operating element 4 is forced to the actuator element 3 from above such that the support plates 4*b* thereon may hold the actuator element 3 therebetween until the arresting projections 3*a* of the actuator element 3 are snapped into the arresting holes 4*c* of the support plates 4*b* making use of the resiliency of the support plates 4*b*, the actuator element 3 and the operating element 4 are united in an integral relationship to each other, thereby constituting the switch operating member 2. In this instance, the projections 4*a* are inserted to intermediate positions of the through-holes 3*c* and thus act as receivers for upper ends of the compression coil springs 7.

Each of the conductor plates 8 is bent in such a manner as to provide a generally V-shaped side elevation as seen in FIG. 1 and has a pair of recesses or notches 8*a* formed on opposite sides at a longitudinal intermediate portion of one of two arms of the V-shape of thereof as clearly seen in FIG. 2. The notches 8*a* provide a fulcrum of rocking motion to the conductor plate 8. Each of the conductor plates 8 has a pair of movable contacts 9 mounted at longitudinal opposite ends thereof.

Up to four fixed contacts 10 are provided at locations of an inner bottom wall of the case 1 corresponding to the movable contacts 9 of the conductor plates 8, and a central terminal 11 is located at the center between the fixed contacts 10 in each pair. Each of the central terminals 11 is formed from a metal plate bent in a substantially L-shape in side elevation and has a pair of arresting projections 11*a* formed at opposite sides of an upper end thereof. The arresting projections 11*a* are bent so as to provide an inclined substantially L-shape in side elevation as clearly seen in FIGS. 1 and 3. The arresting projections 11*a* of each of the central terminals 11 extend through the notches 8*a* of the corresponding conductor plate 8 in such a manner as to hold the conductor plate 8 therebetween. Thus, each of the conductor plates 8 is supported for rocking portion around a fulcrum provided by the corresponding central terminal 11.

Further, up to six terminals 12 are mounted on and extend downwardly through and from the bottom wall of the case 1 and are held in electric connection to corresponding ones of the fixed contacts 10 and the central terminal 11. A pair of lead plates 13 are secured by caulking to those four terminals 12 which are electrically connected to the fixed contacts 10 such that each two fixed contacts 10 shown in FIG. 2 located at diagonal positions are held in normal electric connection by way of one of the lead plates 13 on a lower face of the bottom wall of the case 1.

With the switch device having such construction as described above, when no pressing force acts upon the operating element 4, the switch operating member 2 assumes a neutral position in which the two actuator bars 6 resiliently contact with portions of the conductor plates 8 at or near the V-shaped bent bottoms. At the neutral position, a left side one of the movable contacts 9 on one of the conductor plates 8 which is shown at an upper location in FIG. 2 is held in contact with the opposing fixed contact 10 while a right side one of the movable contacts 9 on the other conductor plate 8 shown at a lower location in FIG. 2 is held in contact with the opposing fixed contact 10. In other words, the movable contacts 9 remote from the the fulcrums of the conductor plates 8 are held in contact with the respective opposing contacts 10 while the other movable contacts 9 are spaced away from the respective opposing contacts 10.

If the operating element 4 is pushed in the direction of the arrow mark X as shown in FIG. 1 from the neutral position, the switch operating member 2 is pivoted in the same direction of the arrow mark X around the fulcrum provided by the pins 3*b* of the actuator element 3 whereupon the actuator bars 6 are slidably moved on the inclined upper faces of the conductor plates 8. In this instance, the conductor plate 8 shown at the upper location in FIG. 2 is not rocked and maintains its position wherein the leftwardly located movable contact 9 is held in contact with the opposing fixed contact 10 while only the other conductor plate 8 at the lower location is rocked in the counterclockwise direction in FIG. 1 around the fulcrum provided by the arresting projections 11*a* of the corresponding central terminal 11 to bring the leftwardly located movable contact 9 into contact with the opposing fixed contact 10, thereby causing switching of the switch device.

Similarly, if the operating element 4 is pushed in the direction of the arrow mark Y in FIG. 1 from the neutral position, now the conductor plate 8 at the lower location in FIG. 2 is not rocked with the rightwardly located movable contact 9 thereon held in contact with the opposing fixed contact 10 while only the other conductor plate 8 at the upper location is rocked in the clockwise direction in FIG. 1 around the fulcrum provided by the arresting projections 11*a* of the corresponding central terminal 11 to bring the rightwardly located movable contact 9 into contact with the opposing fixed contact 10, thereby causing switching of the switch device.

Now, an assembling process of the switch device of the embodiment will be described.

At first, the conductor plates 8 are inserted into the case 1 in which the fixed contacts 10, terminals 11 and 12 and lead plates 13 are already incorporated through the upper opening of the case 1 until the notches 8*a* thereof are engaged with the arresting projections 11*a* of the central terminals 11 as shown in FIG. 2. Subsequently, the pins 3*b* of the actuator elements 3 are inserted into the holes 5 of the tabs 1*a* of the case 1 making use of the resiliency of the tabs 1*a*, and then the actuator bars 6 and the compression coil springs 7 are inserted one after another into the through-holes 3*c* of the actuator element 3 from above. Finally, the operating element 4 is fitted onto the actuator element 3 such that the projections 4*a* thereof may be inserted into the through-holes 3*c* until the arresting projections 3*a* of the actuator element 3 are snapped into the arresting holes 4*c* of the support plate 4*b* of the operating member 4 making use of the resiliency of the support plates 4*b* to unite the actuator element 3 and the operating element 4 in an integral relationship with each other. In this instance, since the projections 4*a* are inserted to intermediate positions of the through-holes 3*c*, the coil springs 7 are pressed at upper ends thereof by lower faces of the projections 4*a*, and consequently the actuator bars 6 are urged to resiliently contact with the upper faces of the conductor plates 8 by the compression coil springs 7.

With the embodiment having such a construction as described above, the components including the conductor plates 8, actuator element 3, actuator bars 6, coil springs 7 and operating elements 4 can all be assembled from above the case 1. Accordingly, automation of an assembling operation which has been considered difficult so far is enabled, and even in the case of assembly by hand, such an assembling operation can be effected readily.

Figure 4:
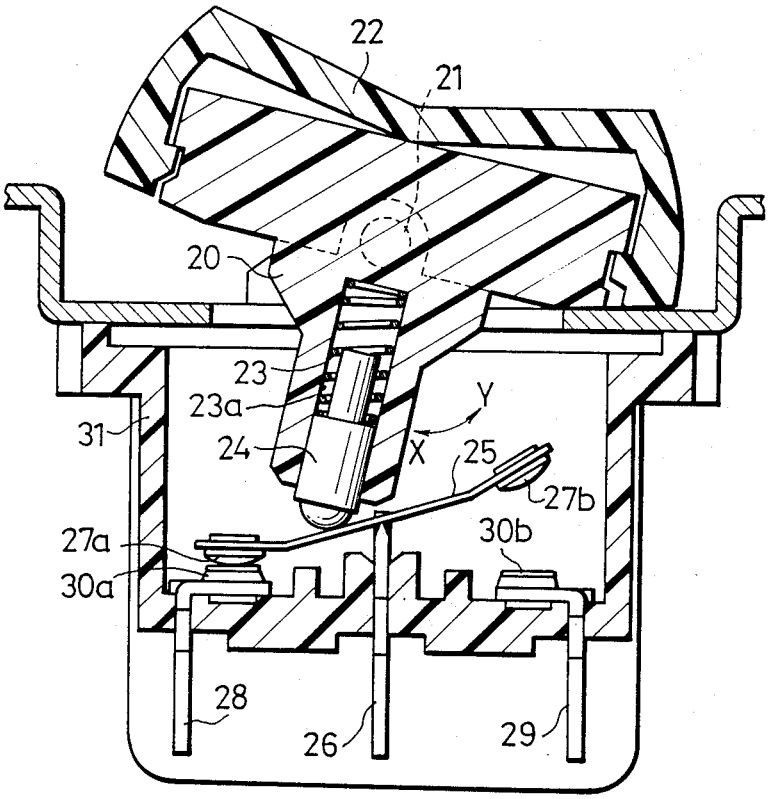
Fig. 4 PRIOR ART
FIG. 4 is a cross sectional view of an exemplary conventional switch device.

It is to be noted that while the embodiment described above is of the interlocking type wherein the pair of conductor plates are alternately rocked by a tilting motion of the switch operating member, it is a matter of course that the present invention can be applied to a switch device of the single-acting type wherein a single conductor plate is rocked by a tilting motion of a switch operating member to cause switching of the switch device as in the conventional switch device described hereinabove with reference to FIG. 4.

Having now fully described the invention, it will be apparent to one of ordinary skill in the art that many changes and modifications can be made thereto without departing from the spirit and scope of the invention as set forth herein.

What is claimed is:

1. A switch device comprising:

a casing having a first end and a second end;

a switch operating member supported for pivotal motion at said first end of said casing, said switch operating member comprising an actuator element and an operating element snap-coupled together in an integral relationship, said actuator element having a throughhole therein forming a first opening and a second opening, said actuator element having formed on first and second opposite faces thereof first and second arresting projections, respectively, said operating element comprising an operating portion and a pair of depending support plates provided in a predetermined spaced relationship extending from said operating portion, each of said depending support plates having an arresting hole formed therein, said operating element further comprising a depending projection positioned between said support plates, said depending projection extending perpendicularly from said operating portion, whereupon when said actuator element and said operating element are snap-coupled together said depending projection is received in said first opening of said through-hole of said actuator element and said arresting projections on said actuator element are received in said arresting holes in said support plates;

a conductor plate supported for pivotal motion within said casing;

an actuator bar positioned in said second opening with a portion of said actuator bar extending out through said second opening of said through-hole in said actuator element and contacting said conductor plate; and a compression spring positioned in said through-hole intermediate said first opening and said second opening and interposed between one end of said depending projection and an inner end of said actuator bar for urging said actuator bar into contact with said conductor plate at an outer end of said actuator bar, whereby a tilting motion of said switch operating member to slidably move said actuator bar on said conductor plate will cause pivotal motion of said conductor plate to make a switching operation of said switch device.

2. A switch device according to claim 1, wherein said actuator element of said switch operating member has a pair of pins formed on third and fourth opposite faces thereof, said casing has a pair of opposing tabs extending from said first end of said casing, each one of said pair of tabs having a hole extending latitudinally therethrough for receiving one of said pair of pins of said actuator element, respectively to support said actuator element and said switch operating member for pivotal motion on said pair of tabs extending from said casing.

3. A switch device according to claim 2, wherein said conductor plate is substantially V-shaped when viewed from a side, said V-shaped conductor plate having a pointed portion and a pair of movable contacts mounted at opposite longitudinal ends thereof for contacting with fixed contacts secured to said second end of said casing, said conductor plate being supported for pivotal motion with an engaging terminal, said engaging terminal being fixably mounted to said casing, said engaging terminal supporting said V-shaped conductor plate at a support point located on one longitudinal side of said pointed portion, said support point being a pivotal fulcrum position so that one of said pair of movable contacts located furthest from said support point of said conductor plate contacts with a corresponding one of said fixed contacts when said switch operating member assumes a neutral position.

4. A switch device according to claim 3, wherein said conductor plate has a pair of notches formed on opposite longitudinal edges at said support point, and said engaging terminal has a pair of pivotal projections formed at a pivotal end thereof, said pivotal projections of said engaging terminal cooperating with said pair of notches of said conductor plate for supporting said conductor plate and for providing pivotal motion from said pivotal end of said engaging terminal.

* * * * *